US007434434B2

(12) United States Patent
Koppensteiner

(10) Patent No.: US 7,434,434 B2
(45) Date of Patent: Oct. 14, 2008

(54) METHOD AND APPARATUS FOR PRODUCING A CYLINDRICAL HOLLOW BODY FROM A BLANK

(75) Inventor: Robert Koppensteiner, Steyr (AT)

(73) Assignee: GFM Beteiligungs- und Management GmbH & Co KG, Steyr (AT)

( * ) Notice: Subject to any disclaimer, the term of this patent is extended or adjusted under 35 U.S.C. 154(b) by 160 days.

(21) Appl. No.: 10/585,224

(22) PCT Filed: Dec. 28, 2004

(86) PCT No.: PCT/AT2004/000458

§ 371 (c)(1),
(2), (4) Date: Jun. 30, 2006

(87) PCT Pub. No.: WO2005/063421

PCT Pub. Date: Jul. 14, 2005

(65) Prior Publication Data

US 2007/0186604 A1 Aug. 16, 2007

(30) Foreign Application Priority Data

Dec. 30, 2003 (AT) ..... A 2097/2003

(51) Int. Cl.
*B21B 19/04* (2006.01)

(52) U.S. Cl. ..... 72/97; 72/76

(58) Field of Classification Search ..... 72/76, 72/97, 125, 264, 370.01, 370.04, 398, 418, 72/422, 208, 209, 402
See application file for complete search history.

(56) References Cited

U.S. PATENT DOCUMENTS

| | | | | | |
|---|---|---|---|---|---|
| 3,648,501 | A | * | 3/1972 | Kralowetz | 72/76 |
| 3,753,365 | A | * | 8/1973 | Kralowetz | 72/76 |
| 3,893,321 | A | * | 7/1975 | Braunwieser | 72/76 |
| 4,129,022 | A | | 12/1978 | Thonnes et al. | |
| 4,157,026 | A | | 6/1979 | Braunwieser | |
| 4,928,507 | A | * | 5/1990 | Staat et al. | 72/38 |
| 5,088,311 | A | * | 2/1992 | Inoue | 72/333 |
| 5,572,897 | A | * | 11/1996 | Aleksandrovich et al. | 72/368 |

FOREIGN PATENT DOCUMENTS

| | | |
|---|---|---|
| EP | 0 610 509 | 8/1994 |
| RU | 2 010 655 | 4/1994 |
| SU | 715195 | 2/1980 |
| SU | 1634 355 | 3/1991 |

OTHER PUBLICATIONS

International Search Report Apr. 5, 2004.

* cited by examiner

*Primary Examiner*—Edward Tolan
(74) *Attorney, Agent, or Firm*—Collard & Roe, P.C.

(57) ABSTRACT

A method is described for producing a cylindrical hollow body from a blank, with the workpiece being opened in the core region by successive swaging which is angularly offset against each other about the axis of the workpiece and being simultaneously pushed onto a piercing mandrel. In order to improve the piercing it is proposed that the workpiece is pressed during the swaging with a predeterminable axial force against the piercing mandrel which can be advanced against the workpiece against this axial force, which piercing mandrel is moved back to its initial position synchronous with the axial feed of the workpiece between the successive swaging steps.

8 Claims, 3 Drawing Sheets

METHOD AND APPARATUS FOR PRODUCING A CYLINDRICAL HOLLOW BODY FROM A BLANK

CROSS REFERENCE TO RELATED APPLICATIONS

Applicant claims priority under 35 U.S.C. §119 of Austrian Patent Application No. A 2097/2003 filed Dec. 30, 2003. Applicant also claims priority under 35 U.S.C. §365 of PCT/AT2004/000458 filed Dec. 28, 2004. The international application under PCT article 21(2) was not published in English.

1. Field of the Invention

The invention relates to a method for producing a cylindrical hollow body from a blank, with the workpiece being opened in the core region by successive swaging which are angularly offset against each other about the axis of the workpiece and being simultaneously pushed onto a piercing mandrel.

2. Description of the Prior Art

For producing a cylindrical hollow body from a continuous blank by forging it is known (EP 0 610 509 B1) to subject the blank to successive radial swaging and to rotate the same about its axis between the individual swaging steps. It has been seen that at a certain degree of deformation caused by forging forces, which degree of deformation covers the core region of the blank and which forging forces act from diametrically opposite sides onto the blank, tensile stresses occur in the core region of the blank which lead to an opening of the core, so that as a result of a step by step rotation of the workpiece between the individual swaging steps it is possible to forge a cylindrical hollow body from the continuous blank. The disadvantageous aspect is however that the core material is opened in an irregular fashion as a result of the unavoidable non-homogeneities and fissures remain in the region of the inner wall of the obtained hollow body which considerably impair the strength properties of the workpiece. In order to avoid such fissures in the region of the inner surface of the hollow body it has already been proposed (SU 715 195A) to open the core by a piercing mandrel which projects into the region of the swaging of the blank, therefore in a region in which the tensile stresses caused by the swaging become effective. These tensile stresses acting upon the core facilitate the penetration of the piercing mandrel into the core of the workpiece, with fissures being avoided when an opening of the core before the mandrel is prevented by the axial position of the mandrel. Since the piercing mandrel penetrates the blank substantially only during the swaging of the workpiece, the axial feed of the workpiece between the individual swaging steps is determined by the elastic deformability of the piercing mandrel in the axial direction, thus considerably limiting the feed of the workpiece. If the piercing mandrel is substantially only used for widening the already opened core of the workpiece (RU 2 010 655 C1), the surface fissures obtained during the opening of the core by the mandrel can only be smoothed and partly covered over because the material oxidizes and cools off in the fissure region to such an extent that even during hot-forging it is no longer possible to weld the fissures in the region of the piercing mandrel.

SUMMARY OF THE INVENTION

The invention is thus based on the object of providing a method for producing a cylindrical hollow body from a blank of the kind mentioned above in such a way that the feed of the workpiece can be increased considerably without having to fear any formation of fissures in the interior surface region of the hollow body.

This object is achieved by the invention in such a way that the workpiece is pressed during the swaging with a predeterminable axial force against the piercing mandrel which can be advanced against the workpiece against this axial force, which piercing mandrel is moved back to its initial position synchronous with the axial feed of the workpiece between successive swaging steps.

Since as a result of these measures the piercing mandrel is advanced against the workpiece during the swaging of the workpiece in order to be returned to its initial position during the axial feed of the workpiece synchronous with the workpiece during the individual swaging steps, the feed of the workpiece depends on the working stroke of the piercing mandrel, so that the feed of the workpiece can be chosen according to the respective piercing conditions. The precondition is that the workpiece is subjected to a sufficient axial force in order to exclude any yielding of the workpiece relative to the piercing mandrel during its working stroke. The axial force to be applied upon the workpiece therefore depends, among other things, on the respective material, the temperature and the deformation properties of the workpiece and the frictional conditions between the piercing tool and the workpiece.

When the workpiece is provided with a centric depression on its face side facing the piercing mandrel prior to swaging, into which depression the piercing mandrel engages at the beginning of the swaging, deformation conditions can be created already in the region of the face side of the workpiece facing the piercing mandrel which ensure a fissure-free inner surface of the hollow body to be produced.

If the workpiece deformation caused with the help of the piercing mandrel in conjunction with transverse forging is not sufficient in order to achieve a predetermined piercing diameter, the piercing diameter of the workpiece can be enlarged gradually in successive steps under swaging.

For the purpose for performing a method for producing a cylindrical hollow body, there is an apparatus comprising at least two forging tools which are situated diametrically opposite of each other with respect to the workpiece, a chuck upstream of the forging tools in the direction of feed of the workpiece, which chuck is connected with an axial feed drive and a rotary drive, and a piercing mandrel which is axially displaceable by means of an actuator on the side of the forging tools opposite of the upstream chuck. If in such an apparatus the chuck upstream of the forging tools is provided with a face-side stop for the workpiece and a pressing cylinder for the workpiece supported on the face side, the piercing mandrel only needs to be provided with a configuration so as to be displaceable axially in a reciprocating fashion via its actuator depending on the feed drive of the chuck in order to advance the piercing mandrel in the case of a respective axial pressurization of the workpiece during the intervention of the forging tools against the feeding direction of the workpiece between the forging tools in order to advantageously pierce the workpiece as a result of the compressive stresses caused by the piercing mandrel and the tensile stresses effective simultaneously in the opening sense as a result of the swaging. When the forging tools are brought out of engagement with the workpiece, the workpiece must be rotated about a predetermined angle about its axis with the help of the chuck upstream of the forging tools and advanced according to the working stroke of the piercing mandrel axially against the forging tools, with the piercing mandrel being returned to its initial position synchronous with the workpiece feed in order to continue and end the piercing in repetitive deformation steps. It is understood that such piercing over the workpiece length can be continuous or extend even only over a partial length.

The axial pressurization of the workpiece can occur with the help of the chuck itself which is upstream of the forging tools when a face-side support of the workpiece in the chuck is ensured and the pressing cylinder acts upon the chuck. More favorable constructional conditions are obtained, however, when the pressing cylinder is provided on the chuck and pressurizes the face-side stop for the workpiece which forms the receiving opening for the piercing mandrel. The feed drive of the chuck can be separated from the pressing cylinder, so that the stroke of the pressing cylinder can be kept small in comparison with the actuating path required for the feed drive. In order to avoid an obstruction of the rotation of the workpiece required between the interventions of the forging tools by axial pressurization of the workpiece by means of the pressing cylinder, the pressing cylinder can be joined to a rotary drive for the face-side stop in order to turn the workpiece synchronously with the face-side stop.

When two chucks are provided which are upstream and downstream of the forging tools, which generally will always be required when the piercing is made over the entire length of the workpiece for the production of a tubular workpiece, the chuck provided downstream of the forging tools must also be provided with a rotary drive. When the workpiece needs to be released from the upstream chuck during the piercing of the workpiece end facing the upstream chuck, the workpiece feed must be ensured by the downstream chuck, which needs to also perform the rotation of the workpiece in combination of the axial feed of the workpiece.

The piercing mandrel can comprise a piercing tool with graduated diameter sections for the gradual enlargement of the diameter of the piercing. The piercing mandrel must be positioned according to the respective work area relative to the forging tools in such a way that for each diameter section of the piercing tool the core opening can be utilized by transverse forging for the piercing. This gradual piercing of the workpiece need not be limited to one direction of passage of the workpiece. It is certainly possible to equip both chucks with a pressing cylinder for pressurizing the workpiece on the face side in order to pressurize the workpiece in both directions of feed with a respective axial force. The piercing mandrel must then axially penetrate the pressing cylinder of the associated chuck in such a case. This piercing in opposite directions of feed can be performed with the help of a single piercing mandrel when the piercing tool relevant for the piercing is exchanged. It is also possible to assign each chuck to a separate piercing mandrel which will then axially penetrate the respective pressing cylinder.

BRIEF DESCRIPTION OF THE DRAWINGS

The method in accordance with the invention will be explained in closer detail by reference to the enclose drawings, wherein.

DESCRIPTION OF THE PREFERRED EMBODIMENTS

Figure 1:
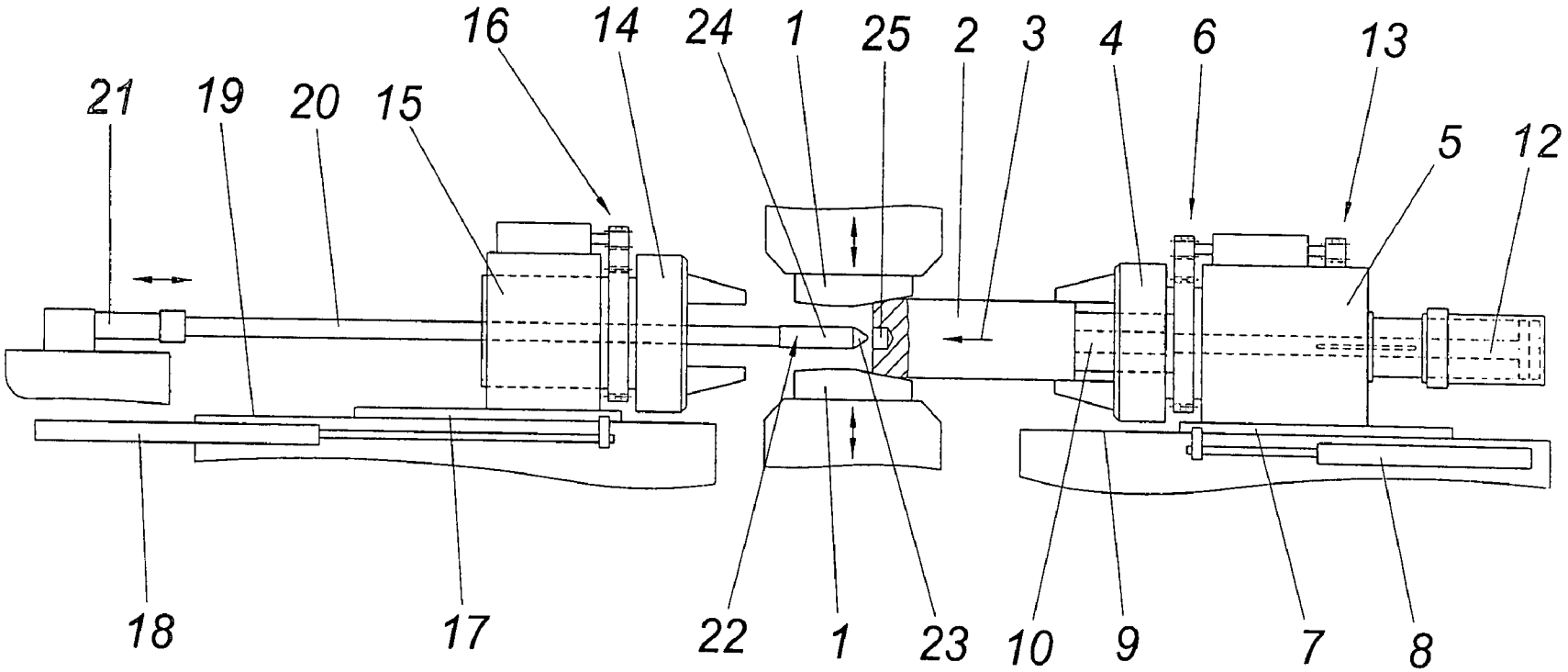
FIG. 1 shows an apparatus in accordance with the invention for producing a cylindrical hollow body in a schematic side view.
Figure 2:
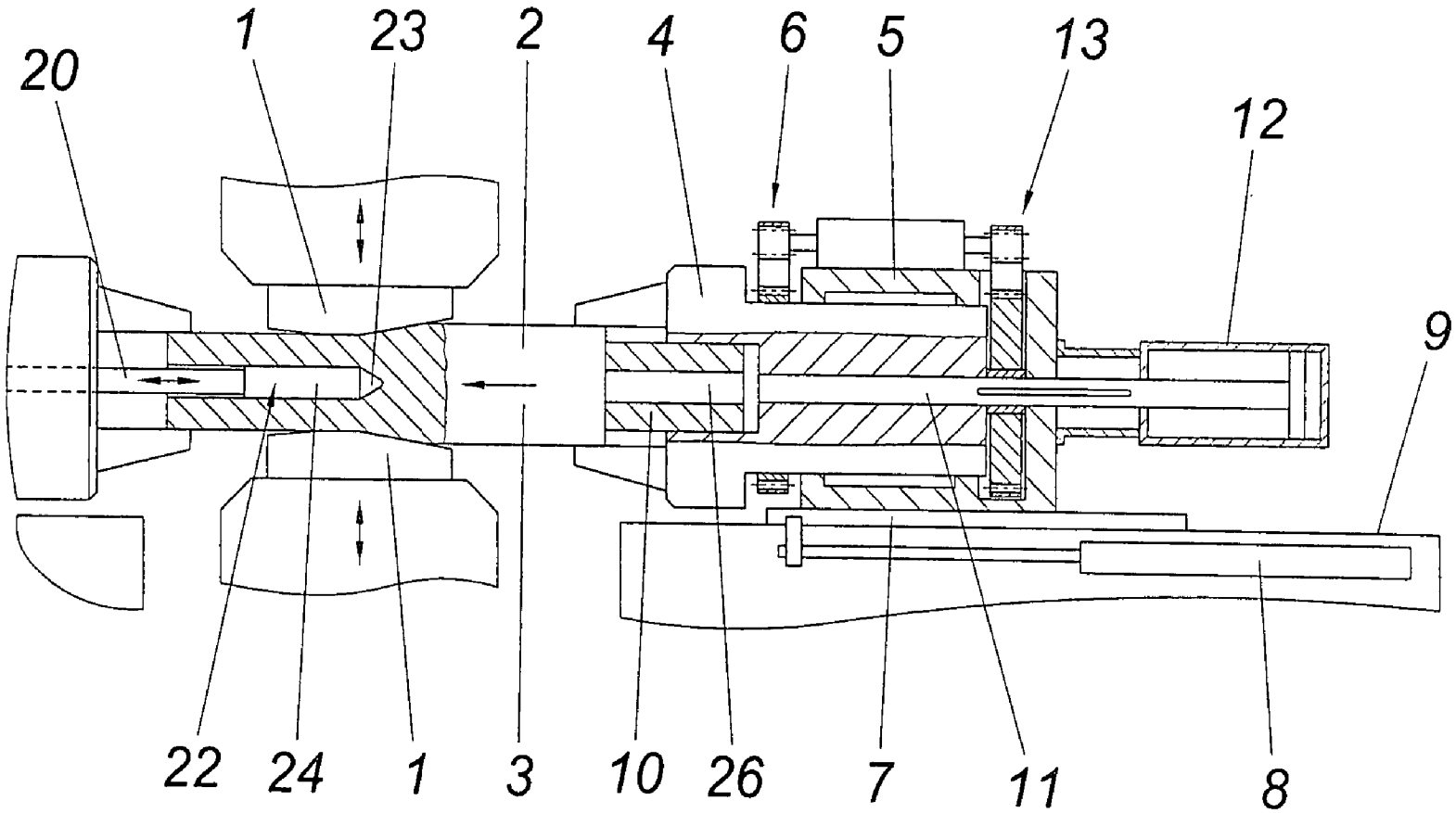
FIG. 2 shows this apparatus in a schematic axial sectional view on an enlarged scale in the region of the forging tools and the chuck upstream of said forging tools.

The illustrated apparatus comprises forging tools 1 in the form of forging hammers which are situated diametrically opposite of each other with respect to the workpiece 2. Although merely two forging tools are shown, two pairs of hammers are usually provided for increasing performance, which pairs of hammers are mutually angularly offset by 90° and are actuated in an alternating fashion. The workpiece 2, which is supplied in the form of a blank with full cross section, but can also already be configured in a tubular manner, is guided with the help of one of the forging tools 1 in the direction of feed 3 of the chuck 4 upstream of the workpiece 2. For this purpose, the chuck 4 is rotatably held in a housing 5 which carries a rotary drive 6 for the chuck 4. The housing 5 with the chuck 4 is adjustable along a guide means 9 by means of a carriage 7 via a feed drive 8, preferably an actuating cylinder. Chuck 4 also comprises a face-side stop 10 for the workpiece 2. Said stop 10 is axially pressurized via the piston rod 11 of a pressing cylinder 12 which is flanged on the housing 5 of the chuck 4. In order to ensure the joint rotation of the stop 10 with the chuck 4, which stop is held in an axially displaceable manner in the chuck 4, a rotary drive 13 for the piston rod 11 can be provided, which rotary drive can be triggered synchronously with the rotary drive 6 for the chuck 4. Notice must be taken that despite the torsionally rigid connection, the axial displaceability of the piston rod 11 is not impaired.

As is shown especially in FIG. 1, a further chuck 14 is downstream of the forging tools 1, which further chuck is also held in a housing 15 and is driven by way of a rotary drive 16. In an analogous fashion, the chuck 14 is held with the housing 15 via a carriage 17 which can be moved by a feed drive 18 along a guide means 19. The hollow chuck 14 is penetrated by a piercing mandrel 20 however which can be driven in a reciprocating manner via an actuator 21 depending on the feed of the workpiece. The piercing tool 22 of the piercing mandrel 20, which projects into the region of the swaging of the workpiece 2 between the forging tools 1, comprises a tapering end 23 and cylindrical calibrating section 24 adjacent thereto, so that the piercing and the calibration can be performed in one pass.

In order to facilitate the piercing of the piercing tool 22 in the entrance face side of the workpiece 2 and to prevent the formation of fissures at the beginning of the piercing, the work piece 2 is provided with a centric depression 25 prior to the actual piercing process, which depression is drilled prior to the chucking of the workpiece 2, but can also be produced after the chucking by the piercing tool 22 itself of by a special tool which can be positioned in the middle of the machine.

For piercing, the workpiece 2 is moved with the help of the feed drive 8 step by step through the forging device in the time intervals in which it is released by the forging tools 1, and is rotated simultaneously with the help of the rotary drive 6 about its axis about a predetermined angular step. The swaging performed by these feed movements by way of the forging tools 1 lead to tensile stresses in the core of the workpiece 2 which act upon the core in the opening sense and support the compressive stresses caused by the piercing tool 22, so that the piercing of the workpiece 2 via the piercing mandrel 20 can be performed with a comparatively low expenditure of force. In order to ensure higher throughput, the piercing mandrel 20 is advanced during the swaging of workpiece 2 between forging tools 1 against the direction of feed 3 of the workpiece 2, with the workpiece 2 being pressurized with a respective pressing force in the direction of feed 3 by the pressing cylinder 12. During the feeding motion of the workpiece 2 between the swaging, the piercing mandrel 20 is returned to its initial position via the actuating cylinder 21 synchronously with the feed drive 8 in order to be advanced again in the next following swaging against the workpiece 2 against the direction of feed 3. When the workpiece 2 is pierced over its entire axial extension, the feed of the workpiece in the axial direction and circumferential direction can no longer be performed by the chuck 4 upstream of the forging tools 1 once the workpiece end associated with this chuck 4 is machined. In this case, the opposite chuck 14 performs the feed motions both in the axial as well as the circumferential direction. The pressurization of the workpiece 2 via the pressing cylinder 12 of the chuck 4 is maintained. The face-side stop 10 for the workpiece 2 is provided with a receiving opening 26 for the piercing tool 22, so that the workpiece support via the pressing cylinder 12 is continuously ensured.

Figure 3:
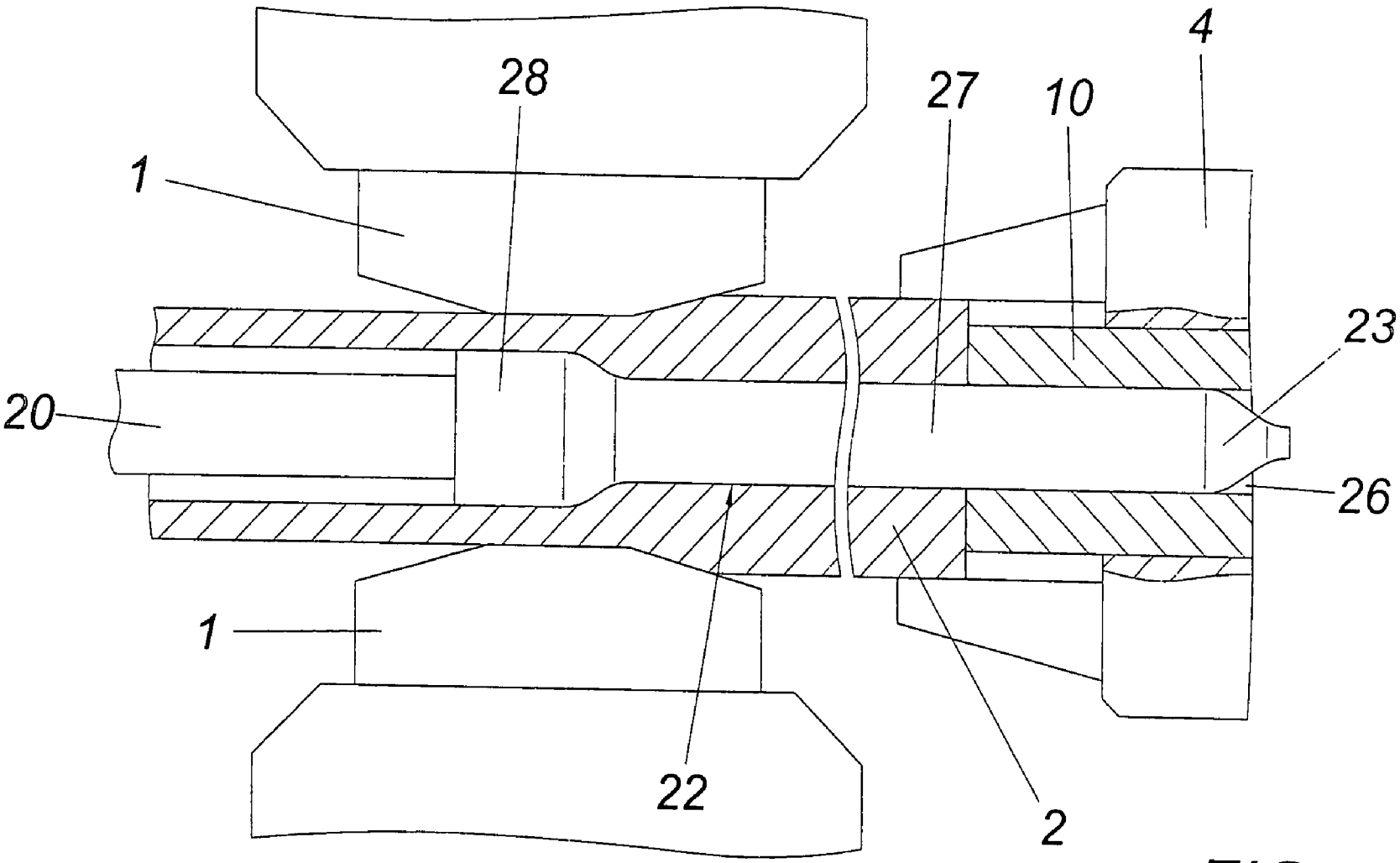
FIG. 3 shows a modified embodiment of an apparatus in accordance with the invention in a schematic axial sectional view in sections in the region of the forging tools on an enlarged scale.

If the piercing width which can be achieved with the diameter of the piercing tool 22 is insufficient, the workpiece 2 can be machined in an incremental manner. Such a machining with the help of a piercing mandrel 20 whose piercing tool 22 comprises two graduated diameter sections 27, 28 is shown in FIG. 3. Once the workpiece 2 has been pierced according to the smaller diameter section 27, the made perforation is widened by means of the larger diameter section 28, which again occurs by simultaneous swaging, so that the tensile stresses effective by such swaging can be used advantageously for the piercing process. In order to perform the widening of the piercing, the piercing mandrel 20 must be displaced by means of the actuator 21 in such a way that the diameter section 28 of the piercing tool 22 comes to lie in the region of the swaging of the workpiece 2 by the forging tools 1.

It is understood that the invention is not limited to the illustrated embodiments. The only relevant aspect is a respective axial pressurization of the workpiece during the working stroke of the piercing mandrel 20, with the working stroke being performed during swaging. The swaging can be performed by forging hammers and also by forging presses. The workpiece 2 can also be hot-formed, semihot-formed or cold-formed. In special cases the forging tools can be triggered in such a way that they are switched over, following the piercing of the workpiece, from a core-loosening to a simultaneous core-compressing impact sequence. The piercing mandrel 20 itself can be held in a non-rotatable way, but also rotate with the workpiece or be rotatably driven in addition relative to the workpiece.

The invention claimed is:

1. A method for producing a hollow body from a blank having an axis, which comprises the steps of successively swaging the blank while simultaneously pushing the blank onto a piercing mandrel in a feeding direction under a predetermined axial force, advancing the piercing mandrel from an initial position in a direction opposite to the feeding direction against said axial force, and returning the piercing mandrel to the initial position synchronously with the axial feeding of the blank between successive swaging steps.

2. The method of claim 1, comprising the further step of providing a central depression in an end face of the blank facing the piercing mandrel prior to swaging the blank.

3. The method of claim 1, comprising the further step of gradually increasing the piercing diameter in successive swaging steps.

4. An apparatus for producing a hollow body from a blank having an axis, which comprises at least two forging tools positioned diametrically opposite each other with respect to the blank, a chuck arranged upstream of the forging tools in a feeding direction of the blank, the chuck being provided with a stop for an end face of the blank, a feed drive and a rotary drive connected to the chuck, a pressing cylinder for pushing the blank supported on the stop, the feed drive feeding the blank supported on the stop in an axial feeding direction, an axially displaceable piercing mandrel arranged downstream of the forging tools, and an actuator connected to the piercing mandrel for reciprocatingly advancing the piercing mandrel from an initial position in an axial direction opposite to the feeding direction and for returning the piercing mandrel to the initial position, synchronously with the feeding of the blank by the feed drive.

5. The apparatus of claim 4, wherein the pressing cylinder is connected to the chuck and the stop has a receiving opening for the piercing mandrel.

6. The apparatus of claim 4, further comprising a rotary drive connected to the pressing cylinder for rotating the stop.

7. The apparatus of claim 4, wherein the piercing mandrel comprises successive sections of different diameters and a piercing tool facing the blank.

8. The apparatus of claim 4, further comprising a chuck arranged downstream of the forging tools, the piercing mandrel passing through the downstream chuck, and the downstream chuck being equipped with a pressing cylinder for pressing against the blank.

* * * * *